US005539927A

United States Patent [19]

Holubec

[11] Patent Number: 5,539,927

[45] Date of Patent: Jul. 30, 1996

[54] HOCKEY GARMENT COMPRISING INNER LEGGINGS AND OUTERWEAR SHORTS ATTACHED THERETO

[76] Inventor: John Holubec, 15947 LeClaire, Oak Forest, Ill. 60452

[21] Appl. No.: 350,423

[22] Filed: Dec. 6, 1994

[51] Int. Cl.[6] ..... A41D 1/06

[52] U.S. Cl. ..... 2/69; 2/227; 2/228

[58] Field of Search ..... 2/69, 227, 228, 2/238, 409, 79, 242

[56] References Cited

U.S. PATENT DOCUMENTS

| | | | |
|---|---|---|---|
| 3,678,514 | 7/1972 | Safrit | 2/409 |
| 3,787,892 | 1/1974 | Quinn | 2/409 |
| 4,091,466 | 5/1978 | Kearn | 2/409 |
| 4,156,294 | 5/1979 | Horn | 2/409 |
| 5,136,727 | 8/1992 | Brisco | 2/409 |

*Primary Examiner*—C. D. Crowder
*Assistant Examiner*—Gloria Hale
*Attorney, Agent, or Firm*—Potthast & Ring

[57] ABSTRACT

A unitary hockey garment (10) having an outerwear pair of shorts (12) for wearing about a lower trunk area of a wearer having at least one leg portion (14) for wearing about at least an upper portion of a wearer's leg. The leg portion (14) defines an opening (16) wherein the leg of the wearer projects with at least one outerwear legging member (18) adapted to be worn snugly about the leg of the wearer. The legging member (18) being tighter fitting than the fit of the pair of shorts (12) about the lower trunk area of the wearer and is substantially tubular in construction and defines another opening (20) to permit the leg of the wearer to project through. Securement of the legging member (18) to the outerwear pair of shorts (12) is positioned within the leg portion (14) of the outerwear pair of shorts (12). A knee pad (28) is worn with the legging member (18) having a portion which overlies and continuously extends downwardly along leg of wearer below knee pad (28) and directly contacting and secured to knee (32) and securement of a portion of legging member (18), which overlies and continuously extends downwardly along the leg of the wearer below knee pad (18) to the leg of the wearer with greater force than provided by legging member (18) with a portion of the legging member (18) extending along the leg of the wearer below knee pad (28) providing underlying support to knee pad (28).

26 Claims, 3 Drawing Sheets

13
12
10
20
22
22
20
14
14
16
16
24
3
3
20
18
18
18
30
30
18
34
36
36
28
32
36
34
36
34
28
2
2

HOCKEY GARMENT COMPRISING INNER LEGGINGS AND OUTERWEAR SHORTS ATTACHED THERETO

BACKGROUND OF THE INVENTION

1. Field of the Invention

The present invention relates to a hockey garment and more particularly to a unitary hockey garment over the lower trunk and legs of a wearer.

2. Description of the Related Art Including Information Disclosed Under 37 CFR 1.97–1.99

Various athletic garments including hockey garments are well known. A number of these garments are of unitary construction which alleviates the necessity of traditional individual segments of clothing. These unitary garments are shown in the following patents: U.S. Pat. No. 3,787,892, issued Jan. 29, 1974, to Quinn; U.S. Pat. No. 4,091,466, issued May 30, 1978, to Kearn; U.S. Pat. No. Des. 267,674, issued Jan. 25, 1983, to Livernois; U.S. Pat. No. 5,052,052, issued Oct. 1, 1991, to Gilford et al.; and U.S. Pat. No. 5,105,473, issued Apr. 21, 1992, to Valtakari.

However, none of these garments have a legging member which is worn to snugly fit over the leg of a wearer and secured to a pair of outerwear shorts which are not as snugly fit over the lower trunk area of a wearer in comparison to the fit of the legging member to the leg of the wearer and in which a portion of the legging member is positioned inside a leg portion of the pair of shorts. Such a construction would provide a unitary hockey garment with a realistic appearance to a segmented hockey garment without the need of support accessories such as garters to hold up legging members.

Furthermore, a number of patents such as to Quinn, to Kearn, to Valtakari and to Gilford show to secure protective pads to the athletic garment by securing them within pockets or enclosures structured from the garment. As in Quinn, a shin pad is secured by a pocket formed in the garment and additional strapping is placed around the leg to overlie the pad and pocket and apply a force to the pad to further secure it to the leg of the wearer. None of these garments utilize solely the garment to overlie a knee pad and extend the garment continuously down the leg of the wearer and provide additional securement of the garment to the leg of the wearer below the knee of the wearer to have the garment provide underlying support to the knee pad.

SUMMARY OF THE INVENTION

It is therefore a principal object of the present invention to provide an easy to wear hockey garment.

Another object of the present invention is to provide a hockey garment that has the appearance of a segmented hockey garment and yet is unitary in construction.

Another object of the present invention is to provide a unitary hockey garment which has an outerwear pair of shorts adapted to be worn about the lower trunk area of the body of the wearer having at least one leg portion adapted to be worn about at least the upper portion of a leg of the wearer in which the leg portion defines an opening to permit the leg of a wearer to project through the opening. The invention further provides at least one outerwear legging member adapted to be worn snugly about the leg of the wearer and is tighter fitting to the leg of the wearer than the fit of the pair of shorts about the lower trunk area of the wearer, in which the legging member is substantially tubular in construction and in which the legging member defines another opening to permit the leg of the wearer to project through the legging. Also, securement of the legging member to the outerwear pair of shorts is provided in which the another opening of the legging member communicates with the opening of the leg portion and in which a portion of the legging member is positioned within the leg portion of the outerwear pair of shorts.

Another object of the present invention is to provide a unitary hockey garment to be worn over a knee pad which is directly in contact with and secured to the knee of the wearer which includes an outerwear pair of shorts adapted to be worn about the lower trunk area of the body of the wearer having at least one leg portion adapted to be worn about at least the upper portion of a leg of the wearer in which the leg portion defines an opening to permit the leg of a wearer to project through the opening. Additionally provided is at least one outerwear legging member adapted to be worn snugly about the leg of the wearer in which the legging member is substantially tubular in construction and defines another opening to permit the leg of the wearer to project through the legging member. The legging member is secured to the pair of shorts to position the opening defined in the leg portion to communicate with the another opening of the legging member and in which the legging member overlies the knee pad and continuously extends downwardly along the leg of the wearer below the knee. Securement of a portion of the legging member, which overlies and continuously extends downwardly along the leg of the wearer below the knee pad, to the leg of the wearer with greater force than provided by the legging member in which the portion of the legging member extending along the leg of the wearer below the knee pad provides underlying support to the knee pad is also provided.

BRIEF DESCRIPTION OF THE DRAWINGS

The foregoing objects and advantageous features of the invention will be explained in greater detail and others will be made apparent form the detailed description of the preferred embodiments of the present invention which are given with reference to the several figures of the drawing, in which.

DESCRIPTION OF THE PREFERRED EMBODIMENTS

Figures 1, 2:
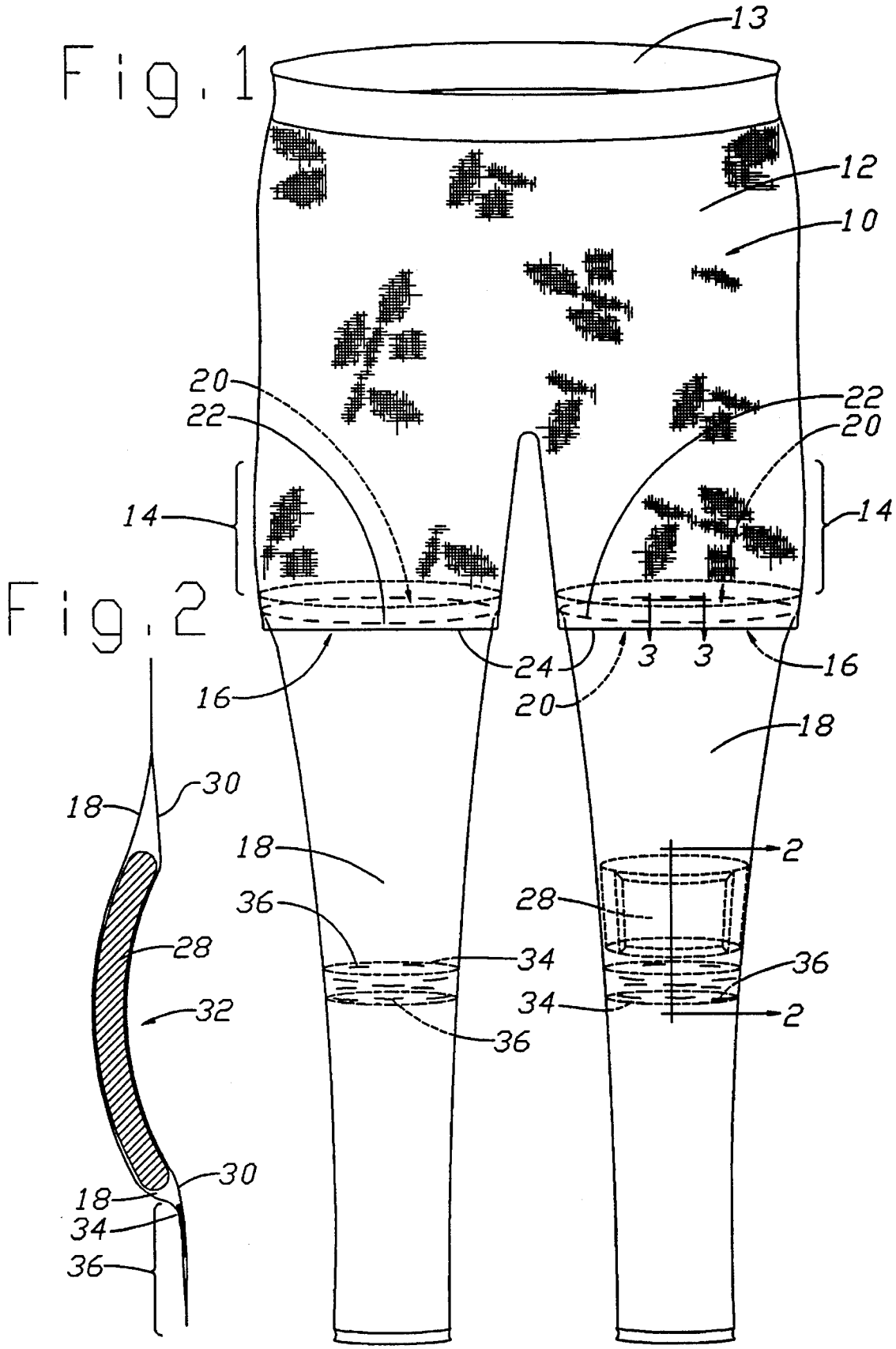
FIG. 1 is a front elevational view of the unitary hockey garment with securement bands in phantom and a knee pad, not part of the initary hockey garment, to be worn by a wearer in phantom.
FIG. 2 is an enlarged cross sectional view along line 2—2 in FIG. 1 including a partial view of the knee pad as it would be worn by a wearer.

Referring now to the drawings, in FIG. 1 is shown a front view of unitary hockey garment 10, which includes outerwear pair of shorts 12 which are adapted to be worn about the lower trunk area of the body of the wearer and are typically held up on the wearer by waist band 13 which is formed with an elastic material and can include a belt or other tying mechanism to secure shorts 12 to the waist of the wearer. Shorts 12 are typically made of a cloth construction and are loosely fitting to permit the hockey player to have ample room for movement and to wear underlying protective gear such as an athletic supporter and cup.

Outerwear shorts 12 have at least one leg portion 14, and as shown in FIG. 1 two leg portions 14 adapted to be worn about at least the upper portion of a leg of the wearer. Each leg portion 14 defines opening 16 to permit the leg of a wearer to project through such opening 16.

Garment 10 has at least one outerwear legging member 18 and in FIG. 1 there are two such members, each of which are adapted to be worn snugly about the leg of the wearer. Legging member 18 is typically constructed of a knit material which is adapted to conform to the contours of the legs of the wearer and provides warmth to the legs of the wearer.

Legging member 18 is tighter fitting to the leg of the wearer than the fit of pair of shorts 12 about the lower trunk of the wearer. The tighter fit provides lesser wind resistance for the hockey player and traps the air to keep the legs warm. Additionally, legging member 18 is substantially tubular in construction to secure around the legs of the wearer and defines another opening 20 to permit the leg of the wearer to project through legging member 18.

As can be seen in FIG. 1, legging member 18 extends from under leg portion 14 of shorts 12 and down along the leg of the wearer to at least the ankle of the wearer. It may be desirable to extend legging member 18 around the foot of the wearer to form a structure much like a sock to engage the foot of the wearer or to form a stirrup at the lower portion of legging member 18 to also engage the foot of the wearer. In either instance, legging member 18 can be pulled taught from the top portion of legging member 18 and the foot will keep legging member from migrating up the leg of the wearer.

Outer wear pair of shorts 12 are secured to legging member 18 by rather conventional approaches such as stitching. Stitches 22 are shown in FIG. 1, in which a portion of legging member 18 is positioned inside of leg portion 14 of outerwear shorts 12. It is preferable to stitch legging member 18 circumferentially about the inside of leg portion 14 to provide a secure connection between legging member 18 and shorts 12.

As can be further seen in FIG. 1, another opening 20 of legging member 18 communicates with opening 16 of leg portion 14 providing ease and quickness in the wearer passing his leg through leg portion 14 and legging member 18 through these virtually concentric items of leg portion 14 and legging member 18.

It is another preferable construction to position stitches 22 above the lowest extension 24 of the leg portion 18 of outerwear pair of shorts 12. This construction optimizes the appearance that the unitary garment 10 has the appearance of a segmented traditional hockey uniform. Legging member 18 has the appearance of passing under leg portion 14 of shorts 12 as if it is not secured to shorts 12.

Figure 3:
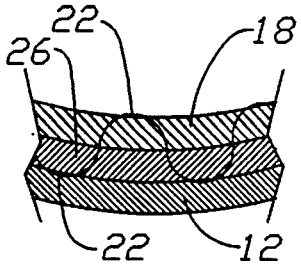
FIG. 3 is an enlarged cross sectional view along line 3—3 in FIG. 1 of another embodiment.

Another preferable construction includes securing legging member 18 to inner member or portion 26 of pair of shorts 12, as seen in FIG. 3. In this construction, inner member 26 is secured to the inner portion of pair of shorts 12 as would typically an inner lining 26 to any garment, such as by stitching lining 26 to shorts 12. Legging member 18 is in turn stitched with stitches 22. As can be seen in FIG. 3, stitches 22 pass through legging member 18 and inner lining 26 and do not pass through outer layer of shorts 12. In this construction, stitches 22 are hidden from ordinary view which further enhances the appearance of a segmented garment. Additionally, this construction further protects stitches 22 from being undesirably cut or broken during play with a layer of material covering them.

In another embodiment of the present invention, unitary hockey garment 10 is to be worn over knee pad 28 worn by wearer of garment 10, as seen in FIGS. 1 and 2. Knee pad 28 traditionally is an elastic band that is worn about the knee area and that carries a padded section to protect the front portion of a knee of a wearer from impact and abrasion.

As described above outerwear pair of shorts 12 adapted to be worn about the lower trunk area of the body of the wearer having at least one leg portion 14 adapted to be worn about at least the upper portion of a leg of the wearer. Leg portion 14 defines opening 16 to permit the leg of a wearer to project through such opening 16.

As also discussed above, legging member 18 is adapted to be worn about the leg of the wearer. Legging member 18 is substantially tubular in construction and defines another opening 20 to permit the leg of the wearer to project through legging member 18. Legging member 18 is secured to pair of shorts 12 to position opening 16 to communicate with another opening 20 of legging member 18. Further, as described earlier legging member 18 is secured to an inside portion of the leg portion 14 of outerwear pair of shorts 12.

As seen in FIG. 1 and 2, legging member 18 overlies knee pad 28 and continuously extends downwardly along the leg 30 of the wearer below knee pad 28 which is directly in contact with and secured to knee 32 of the wearer.

As seen in FIG. 2, securement, with typically an elastic member 34 or the like, of a portion of legging member 18, which overlies and continuously downwardly extends along leg 30 of the wearer below knee pad 28, is provided. Securement with elastic member 34 to leg 30 of the wearer is with greater force than provided by legging member 18, normally of a knit material construction, by itself. Elastic member 34 secures portion 36 of legging member 18 which extends along leg 30 of the wearer immediately below knee pad 28. As a result, legging 18 located immediately below knee pad 28 provides underlying support to knee pad 28.

Figure 6:
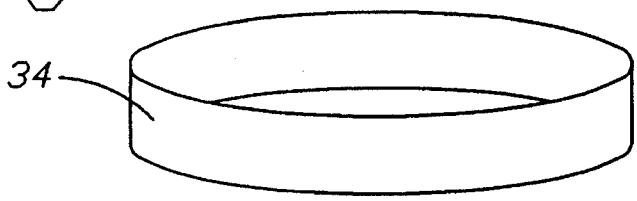
FIG. 6 is an enlarged perspective view of a securement band shown in phantom in FIG. 1, standing alone and unsecured to the unitary hockey garment.

A preferred construction of this securement, as seen in FIGS. 1, 2 and 6, includes elastic member 34 typically an elastic band 34 secured to legging member 18 with stitches 36 or like connectors, at a position immediately below knee 32 of the wearer and is adapted to exert force against leg 30 of the wearer. Elastic member or band 34 is preferably secured circumferentially about and on the interior of the tubular construction of legging member 18 to keep band 34 in a desired position with numerous putting on and taking off of garment 10 while keeping it hidden from an observer.

Figure 4:
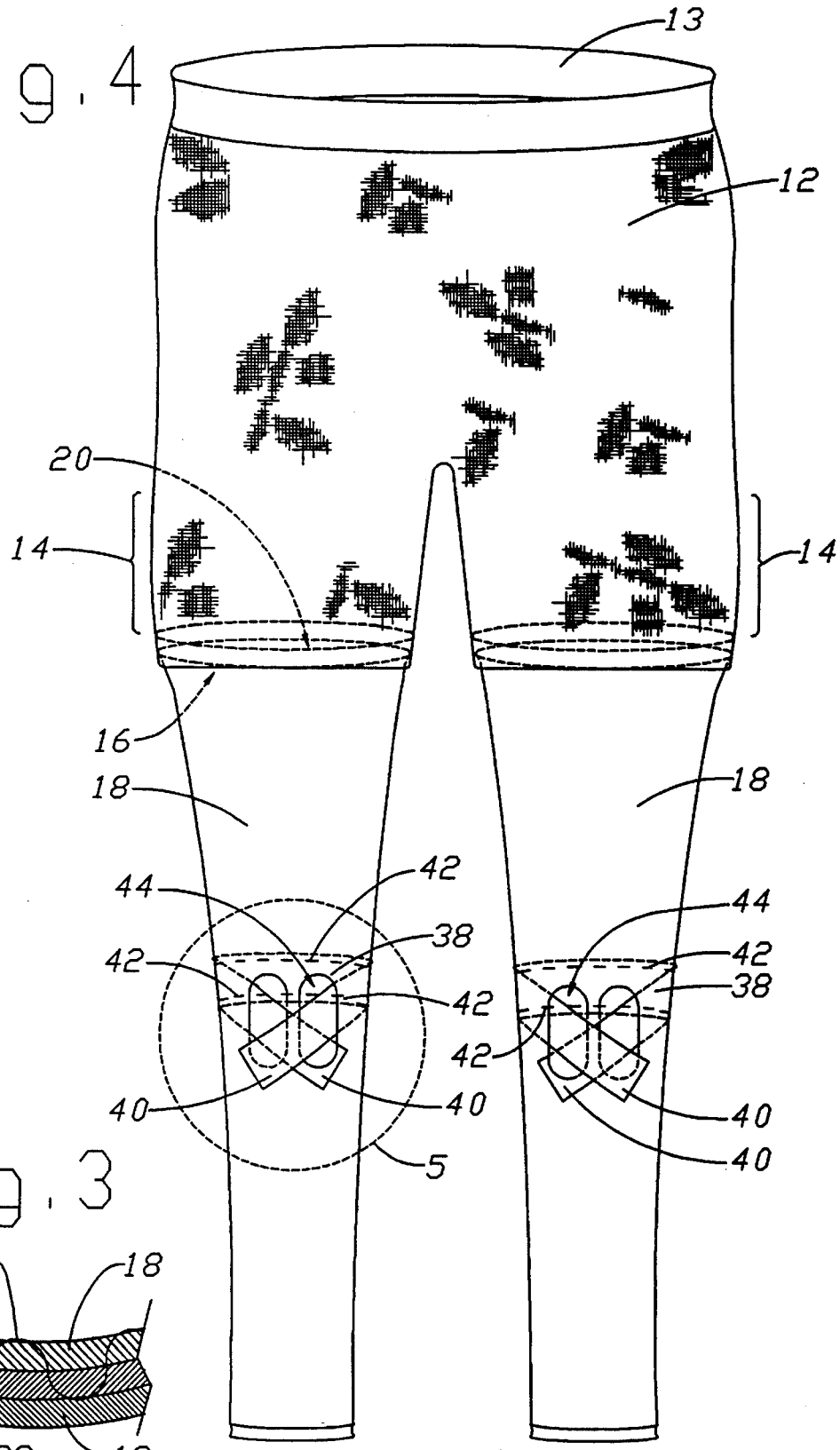
FIG. 4 is a rear elevational view of another embodiment of a securement band of the unitary hockey garment of FIG. 1.
Figure 5:
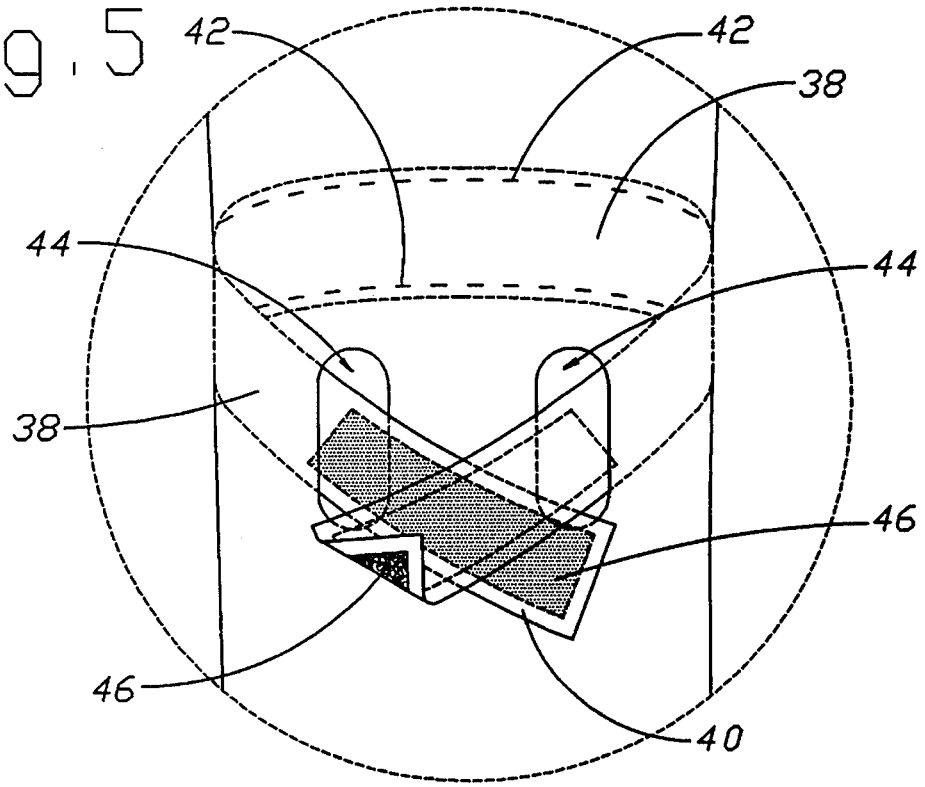
FIG. 5 is an enlarged view of that which is shown in circle 5 in FIG. 4.
Figure 7:
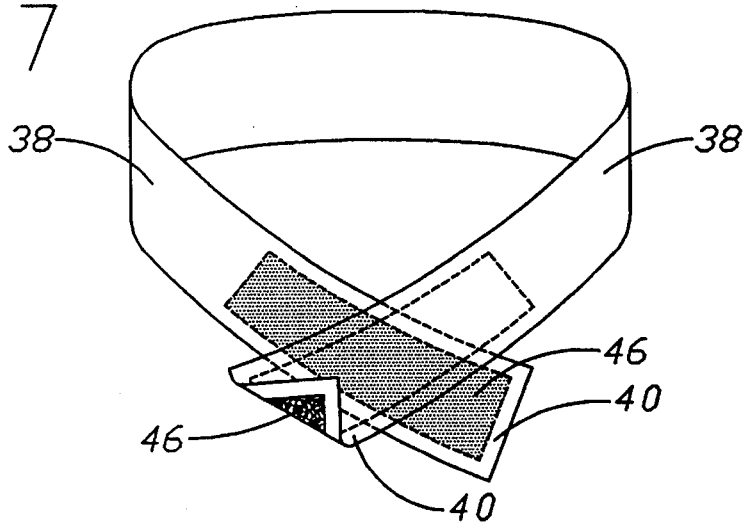
FIG. 7 is an enlarged perspective view of the another embodiment of the securement band of FIGS. 4 and 5 standing alone and unsecured to the unitary hockey garment as shown.

Another embodiment of this securement includes an elastic strip 38, as seen in FIGS. 4, 5 and 7, has two end portions 40 in which a portion of strip 38 is secured to legging member 18 typically with stitches 42 or other typical connector, at a position again below the knee of the wearer.

As can be seen in FIGS. 4, 5 and 7, strip 38 is adapted to surround the leg of the wearer and two end portions 40 overlap one another. As seen in FIGS. 4 and 5, at least one of end portions 40 of the strip 38 project through aperture 44 defined in legging member 18 behind the knee area of legging member 18. Apertures 44 provide the wearer access to pull on end portions 40 of strip 38 an provide a snug fit about the leg of the wearer of strip 38. End portions 40 can then be firmly secured to one another a desired firmness about the leg of the wearer by having each end portion 40 of strip 38 carrying patch of hook and loop mating fastener members 46, such as Velcro, for mating engagement of two end portions 40 of strip 38.

While a detailed description of the preferred embodiments of the invention have been given, it should be appreciated that many variations can be made thereto without departing from the scope of the invention set forth in the appended claims.

I claim:

1. A unitary hockey garment, comprising:

an outerwear pair of shorts adapted to be worn about the lower trunk area of the body of the wearer having at least one leg portion adapted to be worn about at least the upper portion of a leg of the wearer in which the leg portion defines an opening to permit the leg of a wearer to project through the opening;

at least one outerwear legging member adapted to be worn snugly about the leg of the wearer and is tighter fitting to the leg of the wearer than the fit of the pair of shorts about the lower trunk of the wearer, in which the legging member is substantially tubular in construction and in which the legging member defines another opening to permit the leg of the wearer to project through the legging member; and means for securing the legging member to and circumferentially about the inside of the leg portion of the outerwear pair of shorts in which another opening of the legging member communicates with the opening of the leg portion and in which a portion of the legging member is positioned within the leg portion of said outerwear pair of shorts.

2. The unitary hockey garment of claim 1 in which the outerwear pair of shorts has a waist band for securing the at least one garment to the wearer.

3. The unitary hockey garment of claim 1 in which the outerwear pair of shorts is formed of a cloth material.

4. The unitary hockey garment of claim 1 in which the legging member is formed of a knit material and is adapted to conform to the contour of the leg of the wearer.

5. The unitary hockey garment of claim 1 in which the legging member extends from under the leg portion of the outerwear pair of shorts to at least the ankle area of the wearer.

6. The unitary hockey garment of claim 1 includes an elastic member secured to the legging member and adapted to exert force directly against the leg of the wearer.

7. The unitary hockey garment of claim 6 in which the elastic member is an elastic band secured circumferentially about the tubular construction of the legging member.

8. The unitary hockey garment of claim 7 in which the elastic band is secured about an interior of the tubular construction of the legging member.

9. The unitary hockey garment of claim 7 in which the elastic band is secured to the legging member at a position beneath the knee of the wearer.

10. The unitary hockey garment of claim 7 in which the elastic member is a strip having two end portions in which a portion of the strip is secured to the legging member at a position below the knee of the wearer.

11. The unitary hockey garment of claim 10 in which the strip is adapted to surround the leg of the wearer and the two end portions overlap one another.

12. The unitary hockey garment of claim 11 in which the strip is secured to an interior of the legging member and at least one of two end portions of the strip project through an aperture defined in the legging member behind a knee area of the legging member.

13. The unitary hockey garment of claim 11 in which each end portion of the strip carries a patch of hook and loop mating fastener members for mating engagement of the two end portions of the strip with the two end portions in an overlapping position.

14. The unitary hockey garment of claim 1 in which the means for securing include stitches.

15. The unitary hockey garment of claim 14 in which the stitches are positioned above a lowest extension of the leg portion of the outerwear pair of shorts.

16. The Unitary hockey garment of claim 1 in which the leg portion of the outerwear pair of shorts has an inner member secured to an inner portion of the pair of shorts in which the means to secure include securing the legging member to the inner member.

17. The unitary hockey garment of claim 16 in which the inner member includes an inner lining portion to the outerwear pair of shorts.

18. A unitary hockey garment to be worn over a knee pad which is directly in contact with and secured to the knee of the wearer, comprising:

an outerwear pair of shorts adapted to be worn about the lower trunk area of the body of the wearer having at least one leg portion adapted to be worn about at least the upper portion of a leg of the wearer in which the leg portion defines an opening to permit the leg of a wearer to project through the opening;

at least one outerwear legging member adapted to be worn about the leg of the wearer in which the legging member is substantially tubular in construction and defines another opening to permit the leg of the wearer to project through the legging member and in which the legging member is secured to the pair of shorts to position the opening defined in the leg portion to communicate with the another opening of the legging member and in which the legging member overlies the knee pad and continuously extends downwardly along the leg of the wearer below the knee pad; and means for securing a portion of the legging member to the leg of the wearer below the knee pad of the wearer with greater force than provided by the legging member in which the portion of the legging member extending along the leg of the wearer below the knee pad provides underlying support to the knee pad.

19. The unitary hockey garment of claim 18 in which the legging member is secured to an inside portion of the leg portion of the outerwear pair of shorts.

20. The unitary hockey garment of claim 18 in which the securing means includes an elastic member secured to the legging member at a position below the knee of the wearer and adapted to exert force against the leg of the wearer.

21. The unitary hockey garment of claim 20 in which the elastic member is an elastic band secured circumferentially about the tubular construction of the legging member.

22. The unitary hockey garment of claim 21 in which the elastic band is secured about an interior of the tubular construction of the legging member.

23. The unitary hockey garment of claim 18 in which the securing means includes an elastic strip having two end portions in which a portion of the strip is secured to the legging member at a position below the knee of the wearer.

24. The unitary hockey garment of claim 23 in which the strip is adapted to surround the leg of the wearer and the two end portions overlap one another.

25. The unitary hockey garment of claim 24 in which the strip is secured to an interior of the legging portion and least one of two end portions of the strip project through an aperture defined in the legging member behind the knee area of the legging member.

26. The unitary hockey garment of claim 24 in which each end portion of the strip carries a patch of hook and loop mating fastener members for mating engagement of the two end portions of the strip.

* * * * *